US005306015A

United States Patent [19]

Daud et al.

[11] Patent Number: 5,306,015

[45] Date of Patent: Apr. 26, 1994

[54] TIGERS TRAP BOARD GAME

[76] Inventors: Danny S. Daud, 478 Huntley Way N.E., Calgary, Alberta, Canada, T2K 4Z8; George Spector, 233 Broadway Rm 702, New York, N.Y. 10279

[21] Appl. No.: 50,625

[22] Filed: Apr. 22, 1993

[51] Int. Cl.[5] ..... A63F 3/00

[52] U.S. Cl. ..... 273/242; 273/263; 273/290

[58] Field of Search ..... 273/242, 243, 256, 263, 273/290, 288

[56] References Cited

U.S. PATENT DOCUMENTS

| | | | |
|---|---|---|---|
| 1,215,799 | 2/1917 | Hallock | 273/263 |
| 1,321,405 | 11/1919 | Suyehiro | 273/263 |
| 1,518,178 | 12/1924 | Chefko | 273/263 |
| 4,889,345 | 12/1989 | Wawryk | 273/249 |
| 5,026,069 | 6/1991 | Leask | 273/290 X |

FOREIGN PATENT DOCUMENTS

| | | | |
|---|---|---|---|
| 1168603 | 12/1958 | France | 273/263 |
| 538 | of 1903 | United Kingdom | 273/263 |
| 8506 | of 1908 | United Kingdom | 273/263 |
| 432197 | 7/1935 | United Kingdom | 273/263 |

*Primary Examiner*—William Stoll

[57] ABSTRACT

A tigers trap board game is provided and consists of a game board having a playing surface with horizontal, vertical and diagonal lines forming playing position intersections. There are a pair of first playing pieces representing tigers for a first player and a plurality of second playing pieces representing trappers for a second player. When the first playing pieces are trapped during the play of the game by the second playing pieces, cages can be placed onto them to indicate this.

2 Claims, 1 Drawing Sheet

TIGERS TRAP BOARD GAME

BACKGROUND OF THE INVENTION

The instant invention relates generally to games and more specifically it relates to a tigers trap board game, which provides a game played by two players that involves strategy and patience in trapping two tiger playing pieces.

There are available various conventional games which do not provide the novel improvements of the invention herein disclosed.

SUMMARY OF THE INVENTION

A primary object of the present invention is to provide a tigers trap board game that will overcome the shortcomings of the prior art devices.

Another object is to provide a tigers trap board game that involves strategy and patience in playing the game, while the game can only be played by two players.

An additional object is to provide a tigers trap board game in which to win the game a first player with a limited number of trapper playing pieces, must trap two tiger playing pieces of a second player.

A further object is to provide a tigers trap board game that is simple and easy to use.

A still further object is to provide a tigers trap board game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
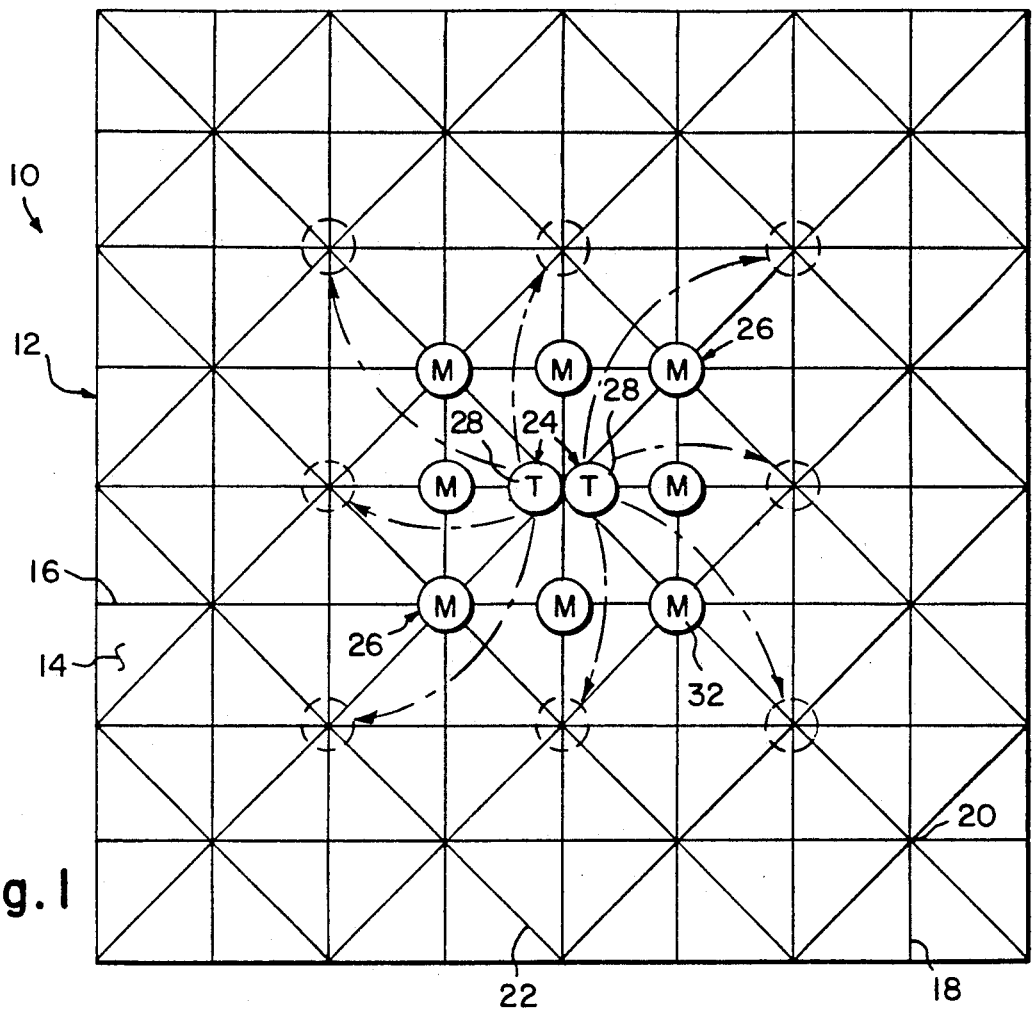
FIG. 1 is a top plan view of the instant invention.
Figure 2:
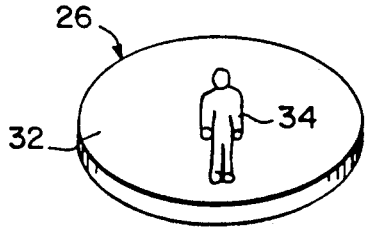
FIG. 2 is a perspective view of one of the trapper playing pieces in greater detail.

Turning now descriptively to the drawings, in which similar reference characters denote similar elements throughout the several views, FIGS. 1 through 4 illustrate a tigers trap board game 10, which consists of a game board 12 having a playing surface 14 thereon. A plurality of horizontal lines 16 are formed on the playing surface 14. A plurality of vertical lines 18 are formed on the playing surface 14 and intersect the horizontal lines 16, thereby indicating playing positions at the intersections thereof. A plurality of diagonal lines 22 are formed on the playing surface 14 and intersect the horizontal lines 16 and the vertical lines 18 at every other intersection 20 thereof.

A pair of first playing pieces 24 representative of tigers are placed together on the intersection 20 at the center of the playing surface 14 at the start of the game. A plurality of second playing pieces 26 representative of trappers are also provided, in which eight are placed on the intersections 20 of the playing surface 14 about the first playing pieces 24 at the start of the game. Each first playing piece 24 is a disk 28 having a picture of a tiger 30 thereon. Each second playing piece 26 is a disk 32 having a picture of a man 34 thereon.

Figure 3:
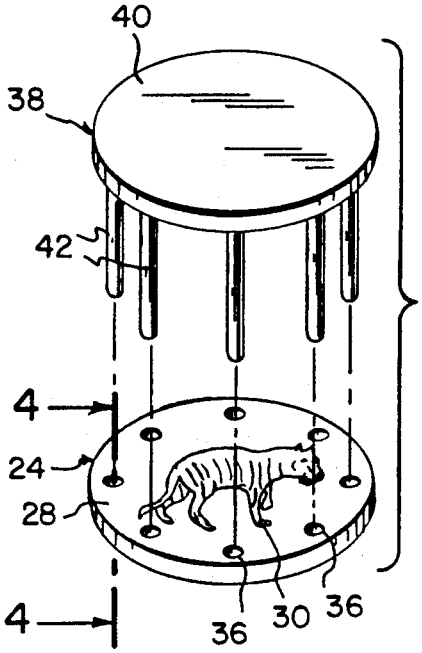
FIG. 3 is a perspective view of one of the tiger playing pieces in greater detail showing the cage exploded therefrom.

Each first playing pieces 24, as shown in FIG. 3, includes the disk 28 having a plurality of apertures 36 about its periphery. A cage 38 is provided being a small flat circular plate 40 with a plurality of bars 42 about its periphery extending downwardly therefrom to engage with the apertures 36 in the disk 28, when the first playing piece 24 is trapped during the play of the game.

Figure 4:
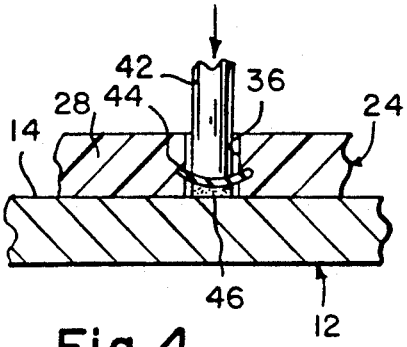
FIG. 4 is an enlarged cross sectional view taken along line 4—4 in FIG. 3, showing a flexible membrane with an adhesive pad being pressed onto the game board by a bar of the cage, when the tiger playing piece is trapped.

As shown in FIG. 4, each first playing piece 24 further contains a flexible membrane 44 located within each aperture 36 of the disk 28. An adhesive pad 46 is attached to the underside of each flexible membrane 44. When a distal end of each bar 42 is inserted within each aperture 36, the adhesive pad 46 will press against the playing surface 14 of the game board 12, to retain the disk 28 of the first playing piece 24 thereto.

Rules Of The Game

The tiger playing pieces 24 can move freely to an intersection 20, as long as it follows the lines 16, 18 and 22. The tiger playing piece 24 can also jump over an odd number of trapper playing pieces 26. Example: one, three, five and seven with the condition there is an empty intersection 20 after the last trapper playing piece 26 that are blocking its movement. An even number of trapper playing pieces 26 will be a block. The tiger playing piece 24 cannot jump over them and take them off the game board 12. The player using the tiger playing pieces 24 will keep all the trapper playing pieces 26 that are jumped over. The tiger playing pieces 24 are put together at the beginning of the game only. After that they require only one intersection 20.

The begin the game, two players must decide who is going to play with the tiger playing pieces 24 and the trapper playing pieces 26. This can be accomplished by tossing dice or a coin. The first player who picks the tiger playing pieces 24 will, but the two tiger playing pieces 24 in the middle intersection 20. The second player then puts eight trapper playing pieces 26 around the tiger playing pieces 24, as shown in FIG. 1. The first player makes a first move and takes one trapper playing piece 26. The first player will keep the trapper playing piece 26 that the tiger playing piece 24 jumps over. The tiger playing piece 24 can move and jump over an odd number of trapper playing pieces 26 in any direction, as long as it follows the lines 16, 18 or 22. The tiger playing pieces 24 can only be moved one at a time. The first player is free to move any tiger playing piece 24, which will suit his strategy. The second player can only put one trapper playing piece 26 at a time on the game board 12. He is free to choose an intersection 20 that will benefit him.

Since the tiger player piece 24 cannot jump over an even number of trapper playing pieces 26, the first player must find other direction on the game board 12.

In order for the second player to win the game, he should be able to block the two tiger playing pieces 24 with one or more trapper playing pieces 26 left in his possession after his last move. The game is a draw if the second player blocks the two tiger playing pieces 24 and has no trapper playing pieces left in his possession after his last move.

While certain novel features of this invention have been shown and described and are pointed out in the annexed claims, it will be understood that various omissions, substitutions and changes in the forms and details of the device illustrated and in its operation can made by those skilled in the art without departing from the spirit of the invention.

What is claimed is:

1. A tigers trap board game which comprises;

a) a game board having a playing surface thereon;

b) a plurality of horizontal lines formed on said playing surface;

c) a plurality of vertical lines formed on said playing surface intersecting said horizontal lines, thereby indicating playing positions at the intersections thereof;

d) a plurality of diagonal lines formed on said playing surface intersecting said horizontal lines and said vertical lines at every other intersection thereof; further including a pair of first playing pieces representative of tigers which are placed together on the intersection at the center of the playing surface at the start of the game; further including a plurality of second playing pieces representative of trappers in which eight are placed on the intersections of the playing surface about said first playing pieces at the start of the game; wherein each said first playing piece is a disk having a picture of a tiger thereon; wherein each said second playing piece is a disk having a picture of a man thereon; wherein each said first playing piece includes;

e) said disk having a plurality of apertures about its periphery; and f) a cage being a small flat circular plate with a plurality of bars about its periphery extending downwardly therefrom to engage with said apertures in said disk, when said first playing piece is trapped during the play of the game.

2. A tigers trap board game as recited in claim 1, wherein each said first playing piece further includes;

a) a flexible membrane located within each said aperture of said disk; and b) an adhesive pad attached to the underside of each said flexible membrane, so that when a distal end of each said bar is inserted within each said aperture, said adhesive pad will press against said playing surface of said game board to retain said disk of said first playing piece thereto.

* * * * *